US007854560B1

(12) United States Patent
Ammons et al.

(10) Patent No.: US 7,854,560 B1
(45) **Date of Patent: *Dec. 21, 2010**

(54) ADHESIVE CONTAINER WITH TEAR-AWAY WIPER ELEMENT

(75) Inventors: James Ammons, 1420 Lawrence Rd., Kemah, TX (US) 77565; Ronald Allan Ammons, Livingston, TX (US)

(73) Assignee: James Ammons, Kemah, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/544,975

(22) Filed: Aug. 20, 2009

(51) Int. Cl.

| | |
|---|---|
| ***A46B 17/08*** | (2006.01) |
| ***A46B 11/00*** | (2006.01) |
| ***A45D 33/00*** | (2006.01) |
| ***A47G 19/00*** | (2006.01) |
| ***B65D 21/02*** | (2006.01) |
| ***B65D 25/00*** | (2006.01) |
| ***B65D 1/40*** | (2006.01) |
| ***B65D 3/28*** | (2006.01) |
| ***B05C 17/00*** | (2006.01) |
| ***B44D 3/00*** | (2006.01) |
| ***B44D 3/04*** | (2006.01) |

(52) U.S. Cl. ..... 401/122; 401/121; 401/126; 401/130; 220/23.9; 220/733; 220/919; 206/1.7; 206/1.8; 206/1.9

(58) Field of Classification Search ..... 401/121, 401/122, 126, 130; 206/1.7, 1.8, 1.9, 81; 220/23.87, 23.9, 273, 495.01, 495.02, 510, 220/571.1, 630, 733, 919, 780
See application file for complete search history.

(56) References Cited

U.S. PATENT DOCUMENTS

| | | | | |
|---|---|---|---|---|
| 332,043 | A * | 12/1885 | Brien | 220/698 |
| 1,696,240 | A * | 12/1928 | Kircher, Jr. | 220/797 |
| 2,313,059 | A * | 3/1943 | Freeman | 220/797 |
| 3,326,409 | A * | 6/1967 | Speer | 220/698 |
| 5,573,340 | A * | 11/1996 | Gueret | 401/126 |
| 5,577,632 | A * | 11/1996 | Blanchette et al. | 220/792 |
| 5,779,093 | A * | 7/1998 | Poole et al. | 220/698 |
| 7,150,378 | B2 | 12/2006 | Dean et al. | |
| 2002/0088811 | A1* | 7/2002 | Lu | 220/780 |
| 2007/0102435 | A1* | 5/2007 | Fera | 220/735 |
| 2009/0092436 | A1 | 4/2009 | Mercier | |

* cited by examiner

*Primary Examiner*—Gregory L Huson
*Assistant Examiner*—Ryan A Varnum
(74) *Attorney, Agent, or Firm*—Buskop Law Group, PC; Wendy Buskop

(57) ABSTRACT

An adhesive container for use with a liquid adhesive, wherein the container comprises a body, a bottom, a side wall and a top. The container can include a stem extending from the lid and a dauber applicator connected to the stem, wherein the dauber applicator and the stem are stored within the container. The dauber applicator retrieves a portion of the liquid adhesive through at least one opening and the wiper removes portions of the liquid adhesive allowing the liquid adhesive to fall back into the body of the container and keep the removed portions of the liquid adhesive from dripping externally to the container.

9 Claims, 4 Drawing Sheets

ADHESIVE CONTAINER WITH TEAR-AWAY WIPER ELEMENT

FIELD

The present embodiments generally relate to a container for use with a fast curing liquid adhesive or epoxy, or paint wherein a brush can be inserted through an opening and a wiper that is integral with the container removes excess portions of the liquid adhesive, allowing portions of the liquid adhesive to fall back into the body of the container without dripping externally on the container, and the brush can be supported on the container.

BACKGROUND

A need exists for a container that prevents dripping and spilling of fast curing liquid adhesive which can be made by an easy metal stamping process with one stamp.

A need exists to prevent spilling of fast curing liquid adhesives or paints that can leak toxic emissions into the environment due to dripping and spilling of these liquids and materials.

A further need exists for a wiper formed in a container that enables the reduction of pollution because of a reduced need to replace the liquid and/or container because of spillage.

The present embodiments meet these needs.

BRIEF DESCRIPTION OF THE DRAWINGS

The detailed description will be better understood in conjunction with the accompanying drawings as follows.

Figure 1:
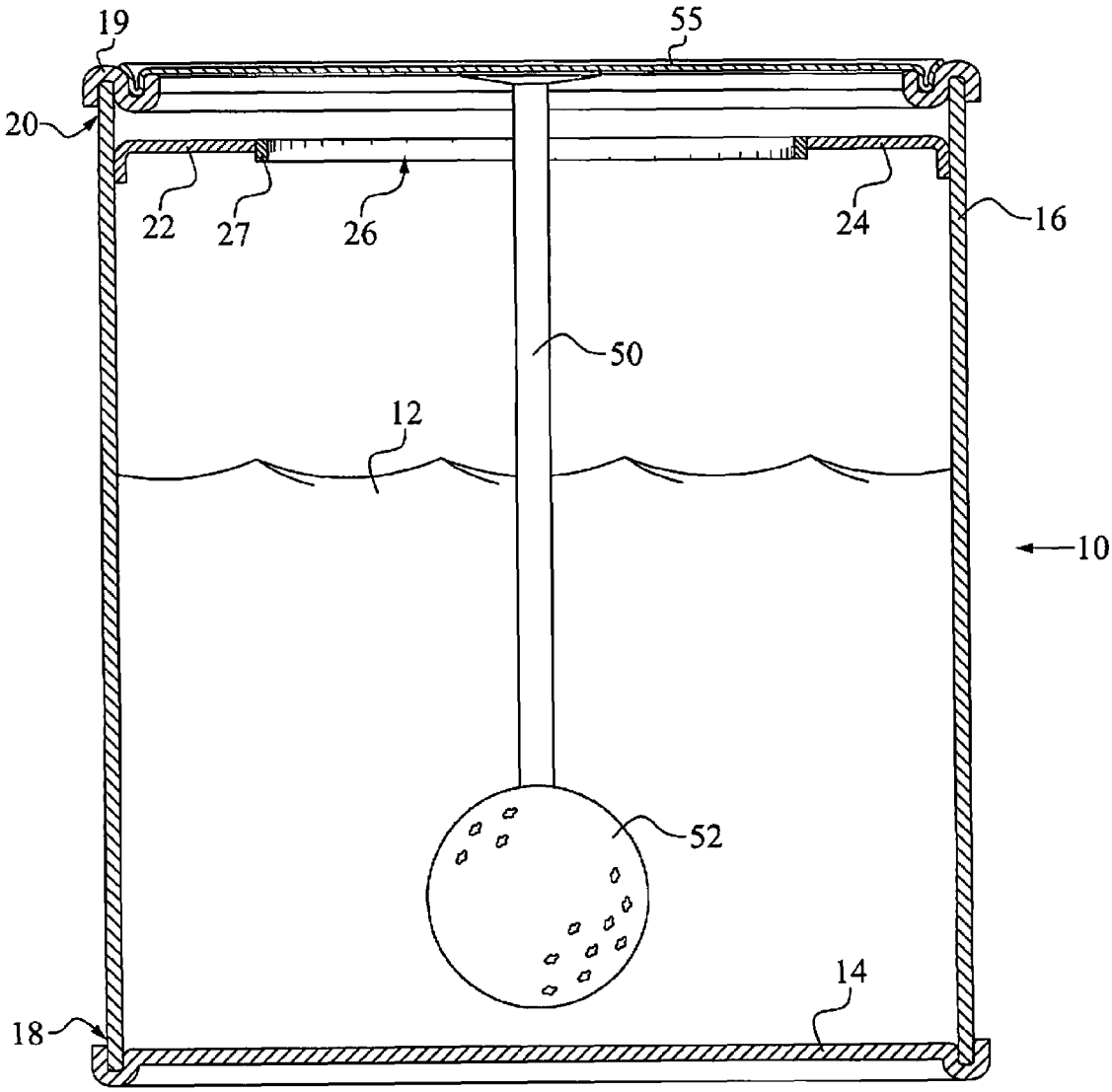
FIG. 1 shows a side cut view of an embodiment of the adhesive container.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to an adhesive container for use with a fast curing solvent welding liquid.

In an embodiment, the fast curing liquid adhesive can be an epoxy for a fast curing liquid adhesive paint or a similar liquid adhesive such as used to install carpets.

Volatile organic chemicals, or VOC's can be stored in the adhesive container, which can reduce the toxic emissions into the environment.

The novel adhesive container can be used to reduce chemical clean up costs, since fewer containers will need to be replaced, reducing the carbon footprint of a user.

The body of the container is useable for holding and/or storing the liquid adhesive. The body has at least a bottom integrally connected to a wall at an angle between about 90 degrees to about 110 degrees. The wall has a first wall end, which engages the bottom, and a second wall end opposite the first wall end. The container body is similar to a paint can on the outside, with a rim.

In an embodiment, the wall forms a top opposite the bottom.

The adhesive container body can be made of tin. In another embodiment, the body can comprise a lightweight metal. The lightweight metal can be an aluminum, a bimetal, or combinations thereof.

An embodiment can contemplate that the body can be a reinforced polymer, such as crystalline homopolymers and copolymers of polypropylene, crystalline homopolymers and copolymers of polyethylene, polyvinyl chloride, or combinations thereof.

The adhesive container can be contemplated to hold between about 4 ounces to about 5 gallons of the fast curing solvent welding liquid.

The adhesive container has a dauber in an embodiment. The dauber can be sealed into the container. This sealing engagement provides an air tight seal between the container and the lid, which enables a longer life, or storage life of the adhesive liquid. This sealing engagement reduces waste of material and saves money by not having to replace material, or liquid, which is dried out and non reusable.

The dauber includes a stem, which extends from a lid, and a dauber applicator connected to the stem opposite the lid. The dauber applicator and the stem can be stored within the adhesive container for as long as there is liquid in the container.

In an embodiment, at least two extensions extend from the top perimeter forming at least two openings. A ring can be disposed between the two extensions, and the ring and the two extensions can permit the dauber applicator to rest external to the adhesive liquid below the top without adhesive dripping externally down the adhesive container when not in use.

In an embodiment, at least four extensions can be used to support the wiper. In this embodiment, at least one opening is formed between each pair of extensions.

Two wipers can then be formed below the top and the two wipers are in parallel to each other.

The wipers can have a plurality of jagged teeth for grabbing the liquid.

The dauber applicator retrieves a portion of the liquid adhesive through the first opening and the wiper removes portions of the liquid adhesive allowing the liquid adhesive to fall back into the body of the container and keep the removed portions of the liquid adhesive from dripping externally down the container.

The adhesive container provides the benefit that once the container is closed, the liquid adhesive will not contact a user's hands, nor will the user have to check after storage of up to twenty four hours if the liquid is dry, since dripping down the sides of the container does not occur.

This container prevents liquid adhesive, or related toxic materials from dripping onto the ground and polluting the environment.

The embodiments of the invention can also prevent dripping the adhesive liquid onto tables, chairs, countertops, or surfaces of a work area and permanently damaging the surface, as the liquid dries in about 1 second to about 3 seconds, in most cases.

The invention further prevents dripping of the liquid adhesive onto the skin and clothes of the user of the liquid adhesive while inserting and removing the dauber applicator into the liquid adhesive, which can also prevent inadvertent ingesting of the toxic material by a user.

In an embodiment, the extensions have at least one perforation allowing for easy tearing off of the wipers without the need for tools. The wiper can be removable by a simple hand twisting, with no extra force needed, in case the user wants to remove the wiper and simply pour the liquid from the container.

In an embodiment, the extensions and the wipers can have a thickness of between about 1/64th inch to about 1/2 inch.

In an embodiment, the opening can be in the center of the container, or a ring version, which provides a container that allows the dauber applicator to rest on the container and keep the adhesive liquid in the container rather than running down the sides of the container.

In an embodiment, the ring forms a first opening through which the dauber applicator can be wiped. The ring is supported by at least four extensions. Each pair of extensions form at least one opening.

In an embodiment, at least two of the openings can be half-moon shaped openings.

The adhesive container can further have a plate extending from the ring towards the bottom of the container and within the container The embodiments provide an adhesive container that reduces fire hazards during storage as well as during use.

The adhesive container can be made of metal, and will resist ignition, as compared to a container with adhesive dripping down the side of a can easily can ignite from a cigarette ash.

The adhesive container allows for simple, user friendly, easy to operate, no instructions needed or any special training required to prevent toxic spills to the environment.

The invention of the adhesive container will have a longer life for product in the container, enabling fewer containers to be created, thereby reducing filling of landfills with containers that had or currently have toxic chemical in them.

Turning now to the Figures, FIG. 1 shows a side cut view of an adhesive container.

The adhesive container can have a body 10 for holding a liquid adhesive 12, such as an epoxy, an adhesive paint, an adhesive for laying carpeting or similar liquid adhesive.

The body 10 can be an integral one piece structure with a bottom 14 connected to a wall 16 as a one piece structure.

While in this embodiment, the wall is shown in a cylindrical shape, the wall can be square shaped, rectangular shaped or have another geometrical shape.

The wall 16 can have a first wall end 18 engaging the bottom 14 and a second wall end 20 opposite the first wall end 18.

The adhesive container can have a top 19 that can be integral with the second wall end 20 opposite the bottom 14.

A channel 21 (shown in FIGS. 3 and 4) can be formed in the top 19 for receiving a lid 55.

A ring 27 can be disposed inside the in the adhesive container. The ring can be supported by extensions 22 and 24. A first opening 26 can be formed by the ring 27. The ring 27 with extensions can form a wiper.

While in this embodiment, the wiper is a ring shape with extensions, it is contemplated that wiper can be square shaped, rectangular shaped or another geometrical shape.

It can also be contemplated that in an embodiment, the wiper components can be hollow to allow for a quick and easy way of breaking the wiper away from the adhesive container.

In an embodiment, the wiper components can be perforated allowing for easy, finger snap removal of the wiper from the adhesive container.

FIG. 1 also shows a stem 50 extending from the lid 55, and a dauber applicator 52 can be connected to the stem 50 opposite the lid 55.

The dauber applicator 52 can retrieve a portion of the adhesive liquid 12, as shown in FIG. 1, through the first opening 26 near the top 19.

The wiper can remove portions of the adhesive liquid 12, and can allow the adhesive liquid 12 to fall back into the body 10 of the adhesive container. This wiping of the adhesive liquid can prevent the excess adhesive welding liquid 12 from dripping externally down the sides of the adhesive container forming a fire hazard.

The dauber applicator 52 and the stem 50 can be stored within the adhesive container when not in use.

Figure 2:
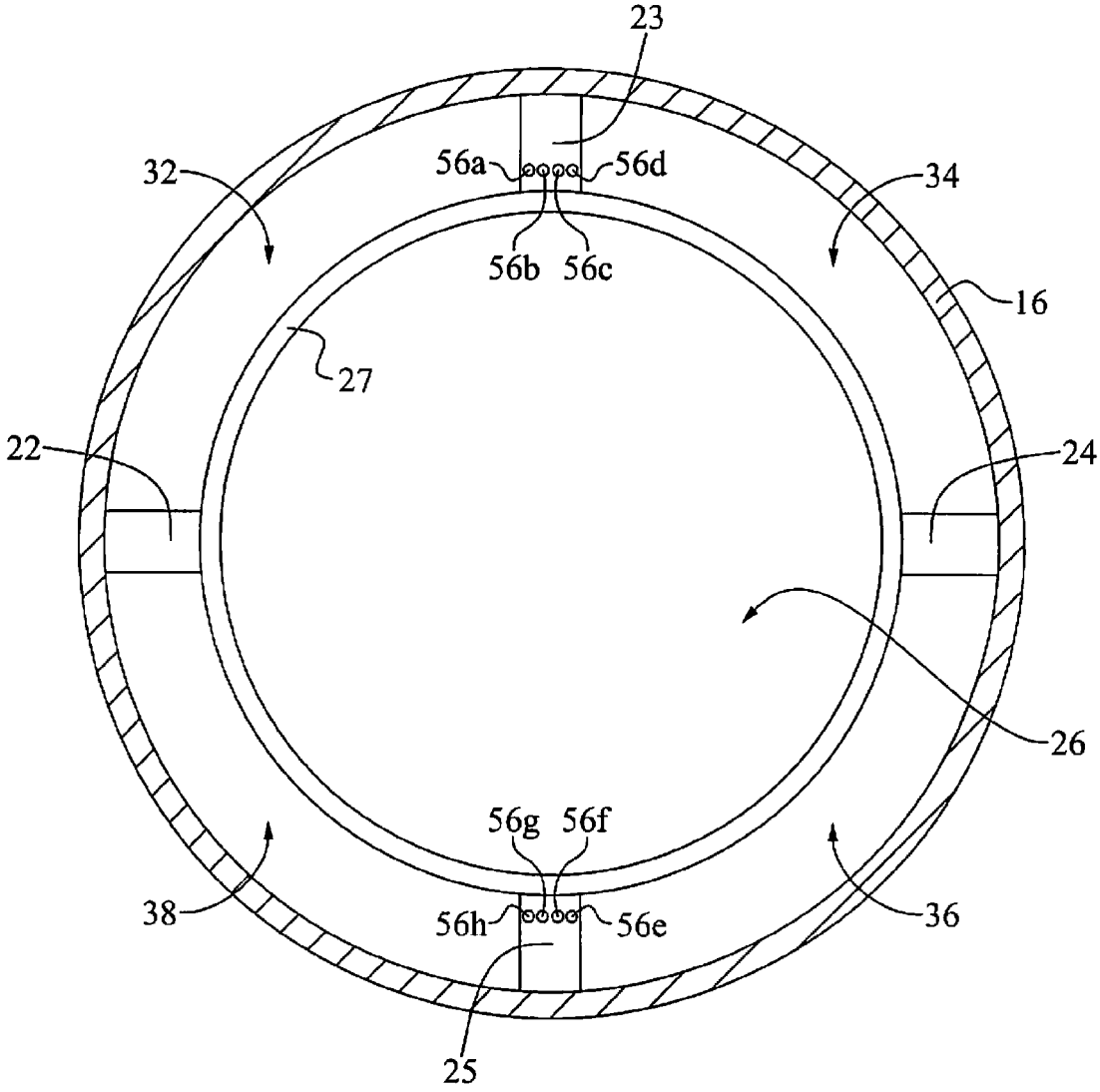
FIG. 2 shows a top cut view of the adhesive container with a wiper.

FIG. 2 shows a top cut view of the adhesive container with a wiper.

In FIG. 2, extensions 22, 23, 24 and 25 can be seen engaging the ring 27 forming openings 32, 34, 36 and 38. While four extensions are shown in this embodiment, it can be contemplated in other embodiments, two or more extensions can be used.

It can be contemplated that the wiper with the extensions can permit the dauber applicator to rest external to the adhesive liquid without dripping externally down the sides of the adhesive container, when not in use.

While perforations **56*a*-56*h* are depicted in the extensions 23 and 25, each of the extensions 22, 23, 24, and 25 can have at least one perforation. The perforations can allow for easy tearing off of the ring 27 from the adhesive container without the need for tools, just a finger snap removal. The perforations can have a diameter of about 1 micron to about 2 microns each. The first opening 26**, known also as "the central opening" is shown.

Figure 3:
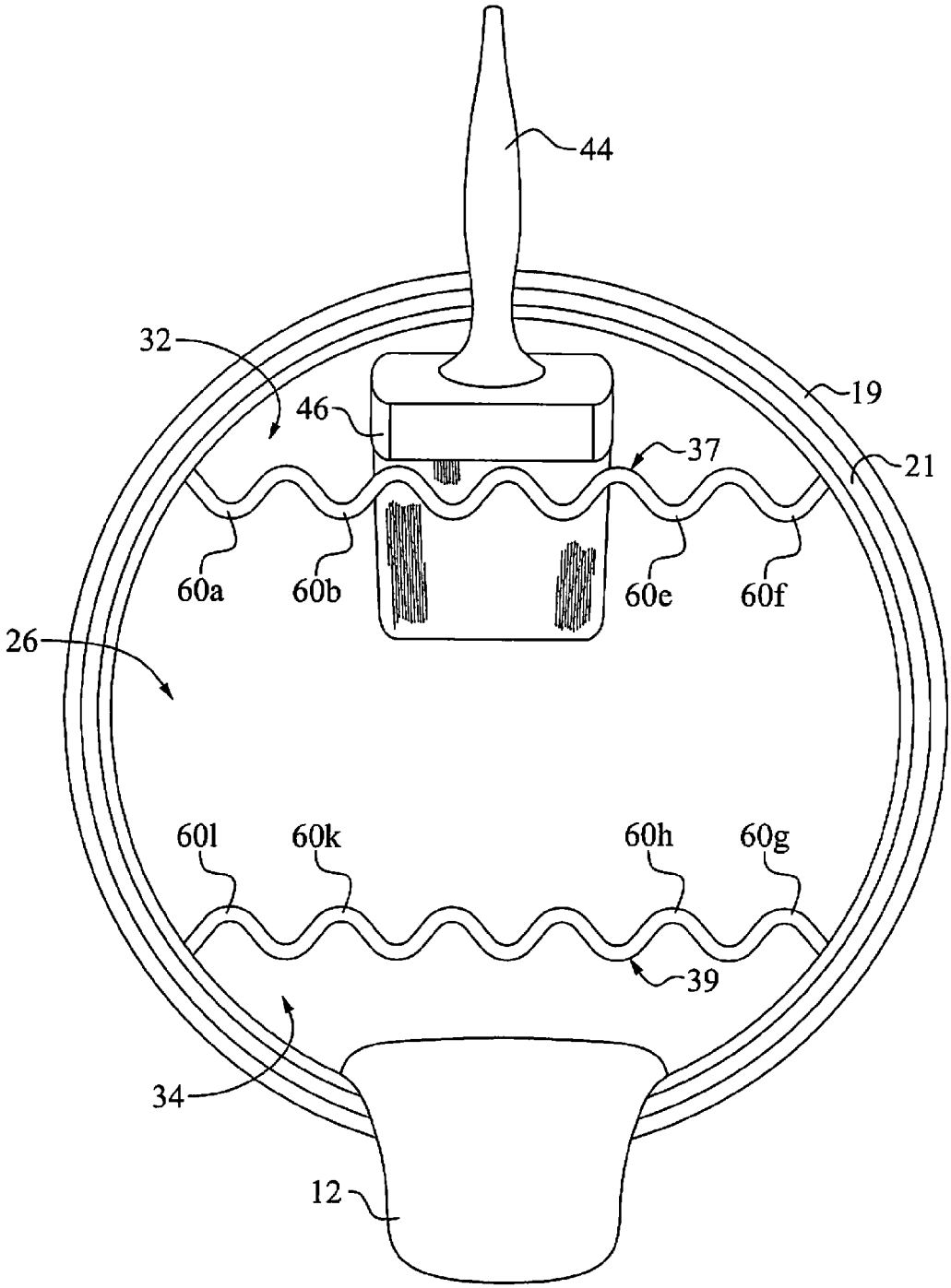
FIG. 3 shows a top view of the adhesive container with an alternative embodiment of a wiper.

FIG. 3 shows a top view of the adhesive container with an alternative embodiment of the wiper. In this embodiment, two wipers 37 and 39 are shown stretching across the adhesive container, below the top with channel 21. The two wipers can be in parallel with each other.

Each wiper can have a plurality of jagged teeth **60*a*-60*l* for grabbing the adhesive liquid 12 from the applicator portion of a brush 46 with a handle 44**.

Two moon shaped openings 32 and 34 are viewable in this embodiment. The moon shaped openings 32 and 34 can be used to pour out the adhesive liquid 12 from the adhesive container.

Figure 4:
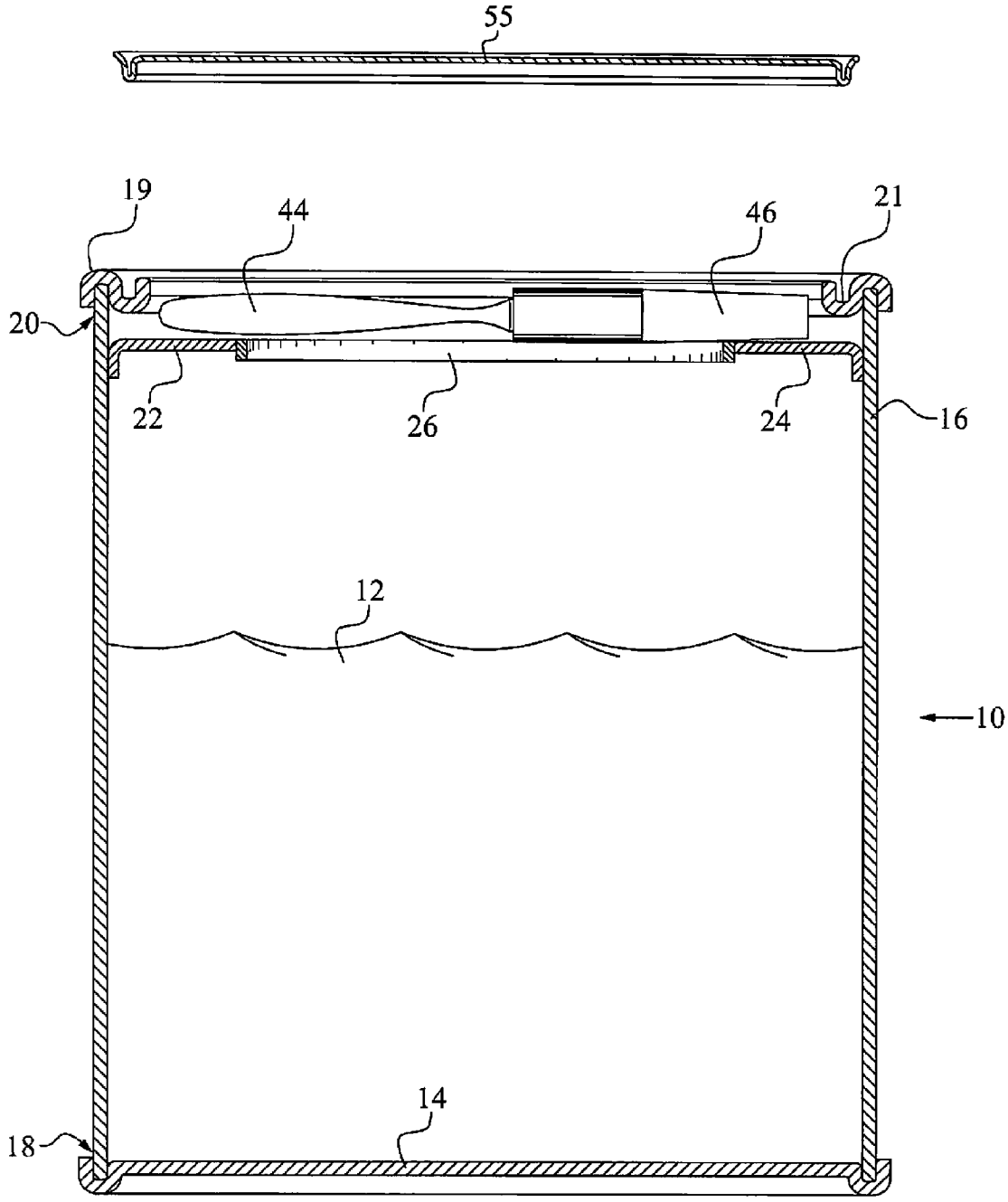
FIG. 4 shows a side cut view of the adhesive container supporting a brush.

FIG. 4 shows the adhesive container 10 with the an application portion of a brush 46 with a handle 44. The application portion of a brush 46 is shown resting on the ring 27 beneath the lid 55 that is shown above the top.

Channel 21 can be seen formed in the top 19 for receiving the lid 55.

While these embodiments have been described with emphasis on the embodiments, it should be understood that within the scope of the appended claims, the embodiments might be practiced other than as specifically described herein.

What is claimed is:

1. An adhesive container comprising:

a. a one piece body for holding a liquid adhesive, wherein the body has a bottom integrally connected to a wall encircling the bottom at an angle between 90 degrees to 110 degrees, and wherein the wall has a first wall end engaging the bottom and a second wall end opposite the first wall end, and a top detachably connected to the second wall end opposite the bottom having a channel and creating a first opening;

b. a ring disposed in the first opening and connected to the top with at least two extensions forming at least a second opening and a third opening, wherein the second opening and the third opening allow the liquid adhesive to flow from at least one of the second opening and the third opening in the top, wherein the ring and the at least two extensions permit an applicator to rest external to the liquid adhesive without dripping the liquid adhesive externally on the adhesive container when not in use, and wherein each extension comprises at least one perforation allowing for easy tearing off of the ring from the top without the need for tools; and c. a lid for covering the ring, wherein the lid forms a sealing engagement with the channel in the top to prevent spillage of the liquid adhesive from the adhesive container.

2. The adhesive container of claim 1, wherein the lid further comprises a stem extending from the lid, and a dauber applicator connected to the stem opposite the lid, and wherein the dauber applicator and the stem are stored within the adhesive container.

3. The adhesive container of claim 2, wherein the dauber applicator retrieves a portion of the liquid adhesive through at least one of the openings and the ring removes portions of the liquid adhesive, allowing the liquid adhesive to fall back into the body of the adhesive container from the ring, thereby preventing the removed portions of the liquid adhesive from dripping externally down the wall of the adhesive container.

4. The adhesive container of claim 1, wherein the body is made of tin.

5. The adhesive container of claim 1, wherein the body comprises a lightweight metal selected from the group consisting of aluminum and bimetal.

6. The adhesive container of claim 1, wherein the body comprises a reinforced polymer selected from the group consisting of: a crystalline homopolymer and copolymers of polypropylene, crystalline homopolymers and copolymers of polyethylene, polyvinyl chloride, and combinations thereof.

7. The adhesive container of claim 1, wherein the adhesive container is adapted to hold between 4 ounces to 5 gallons of the liquid adhesive.

8. The adhesive container of claim 1, wherein at least four extensions support the ring, and wherein at least one opening is formed between each pair of extensions.

9. The adhesive container of claim 1, wherein each of the extensions and the ring has a thickness of between 1/64th inch to 1/2 inch.

* * * * *